US007344148B2

(12) United States Patent
Donze et al.

(10) Patent No.: US 7,344,148 B2
(45) Date of Patent: Mar. 18, 2008

(54) DEVICE FOR VARYING THE RADIAL GEOMETRY OF A SKI PROPORTIONALLY TO ITS FLEXION AND SKI EQUIPPED THEREWITH

(75) Inventors: Claude Donze, Vercorin (CH); Daniel Vuichard, Bern (CH)

(73) Assignee: Scott Sports SA, Givisiez (CH)

( * ) Notice: Subject to any disclaimer, the term of this patent is extended or adjusted under 35 U.S.C. 154(b) by 206 days.

(21) Appl. No.: 10/494,720

(22) PCT Filed: Nov. 7, 2002

(86) PCT No.: PCT/CH02/00603

§ 371 (c)(1),
(2), (4) Date: May 6, 2004

(87) PCT Pub. No.: WO03/039686

PCT Pub. Date: May 15, 2003

(65) Prior Publication Data

US 2005/0006875 A1 Jan. 13, 2005

(30) Foreign Application Priority Data

Nov. 8, 2001 (CH) ..... 2063/01

(51) Int. Cl.
*A63C 5/06* (2006.01)

(52) U.S. Cl. ..... 280/602

(58) Field of Classification Search ..... 280/601, 280/602, 607, 809, 22, 22.1
See application file for complete search history.

(56) References Cited

U.S. PATENT DOCUMENTS 4,778,197 A * 10/1988 Floreani ..... 280/602
5,284,357 A * 2/1994 Tinkler ..... 280/602
5,301,965 A * 4/1994 Floreani ..... 280/600
5,417,448 A * 5/1995 Le Masson et al. ..... 280/602
5,597,170 A * 1/1997 Le Masson et al. ..... 280/602
5,845,923 A * 12/1998 Zanco ..... 280/607

FOREIGN PATENT DOCUMENTS

| | | | |
|---|---|---|---|
| DE | 84 22 316 | | 9/1984 |
| DE | 100 49 011 | A1 * | 5/2001 |
| EP | 1 297 869 | | 4/2003 |
| FR | 2794374 | * | 12/2000 |
| WO | 02/40115 | | 5/2002 |

* cited by examiner

*Primary Examiner*—Frank Vanaman
(74) *Attorney, Agent, or Firm*—Oblon, Spivak, McClelland, Maier & Neustadt, P.C.

(57) ABSTRACT

The invention relates to a mechanical device for modifying the radial geometry of a ski, proportionally to its flexion, which includes elements, referred to as transmission elements, which, each interposed between the rod and the ski wherein each transform a relative displacement of the rod, oriented along its longitudinal axis and directed towards one of the ends of the ski (direction S1), into a second displacement oriented along a direction intersecting the longitudinal axis and directed towards the outside of the ski and wherein each apply this displacement at a selected place of the ski so as to bring about, during the relative displacement of the rod, a thrust generating the deformation of this ski along its cross-section, transverse deformation translated, in particular, through a spacing apart in the upper part of the ski and through the desired modification of the geometry of the lower face of this ski.

18 Claims, 4 Drawing Sheets

DEVICE FOR VARYING THE RADIAL GEOMETRY OF A SKI PROPORTIONALLY TO ITS FLEXION AND SKI EQUIPPED THEREWITH

TITLE OF THE INVENTION

This invention relates to a device for modifying the radial geometry of a ski, and this proportionally to the flexion of this ski.

The invention likewise relates to a ski equipped with this device.

BACKGROUND OF THE INVENTION

Field of the Invention

The device functions regardless of the technique of composite construction of the ski ("sandwich," monocoque or other construction).

The term ski is intended to mean any blade used for resting on or sliding on snow, i.e. in effect a ski as such, but also a monoski, a snowboard or other board.

Mechanical device for modifying the radial geometry of a ski, proportionally to its flexion, is intended to mean a device exploiting the relative displacement of at least one rod oriented substantially longitudinally to the ski for causing, in a selected zone of this ski, a deformation of the ski along its transverse section and bringing with it the desired modification sought of the geometry of its lower face.

Such a device has been described in the international application WO 02/40115, of the holder.

With this device, the radial geometry of the ski, for example slightly convex when the ski lies flat on a support, becomes gradually concave as the ski is stressed in flexion during its use owing to a pressing force applied by a skier in the median part of this ski and gripping reactions developed by the support in front of and behind this median part and in particular at the level of the spatula and of the heel of the ski.

This modification or adaptation of the radial geometry of the ski as a function of flexion stresses makes it possible to improve the general performance of the ski as well as its efficiency.

With such a device, the turn initiation and hold of the ski in curves are facilitated.

The presence of said device on a ski likewise makes it possible to dampen the vibrations of this ski.

Owing to the possibilities of adjustment which it allows, the device permits the ski to be adapted to the quality of the snow and/or the requirements of the user.

A result which the invention aims to obtain is a device of the previously cited type which makes it possible to control perfectly the longitudinal dimension of each part of the ski in which the radial geometry must be modified.

Another result which the invention aims to obtain is a device of the previously cited type which, after removal of flexion stress which has generated a modification of the radial geometry of the ski, guarantees the re-establishment of the radial geometry in its initial state.

BRIEF SUMMARY OF THE INVENTION

To this end, the invention has as its subject matter a device of the previously cited type, in particular characterized in that it comprises elements, referred to as transmission elements, which, are each interposed between the rod and the ski:

each transform a relative displacement of the rod, oriented along its longitudinal axis and directed towards one of the ends of the ski (direction S1), into a second displacement oriented along a direction intersecting said longitudinal axis and directed towards the outside of the ski, each apply this displacement at a selected place of the ski so as to bring about, during said relative displacement of the rod, a thrust generating the deformation of this ski along its cross-section, translated transverse deformation, in particular through a spacing apart in the upper part of the ski and through the desired modification of the geometry of the lower face of this ski.

The invention also has as its subject matter a ski equipped with this device.

BRIEF DESCRIPTION OF THE DRAWING

The invention will be better understood by reading the following description, given with reference to the attached drawing representing schematically.

DETAILED DESCRIPTION OF EMBODIMENTS

Figure 1:
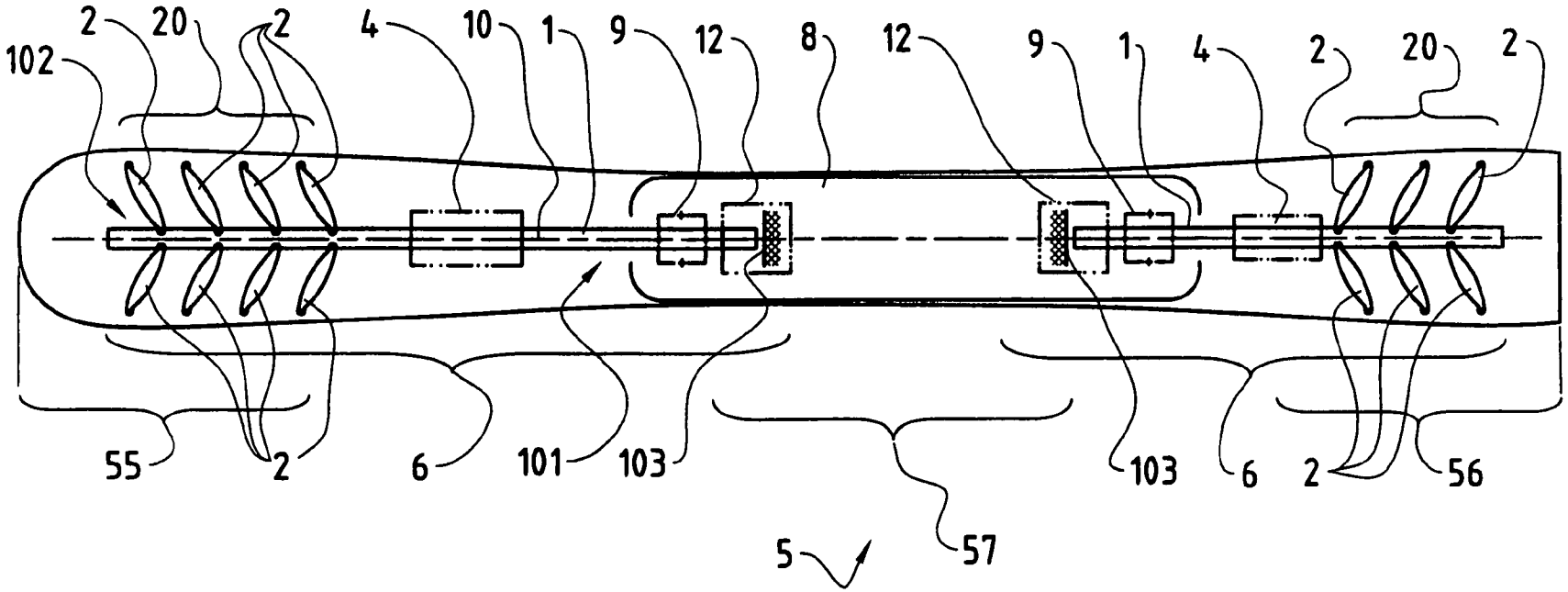
FIG. 1 is a view from above of a ski equipped with a device according to the invention, in a first embodiment.

Referring to the drawing, one sees a ski 5 equipped with at least one device 6 for modification of its radial geometry.

Figure 3:
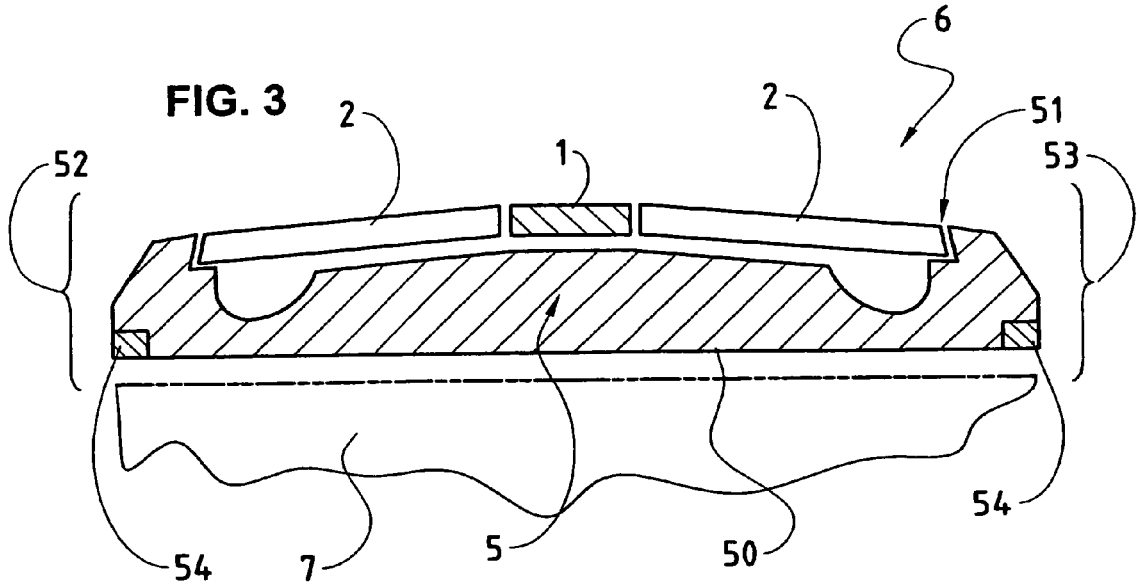
FIG. 3 is a view in transverse section of the ski of FIG. 2, before modification of the transverse section of this spatula.
Figure 4:
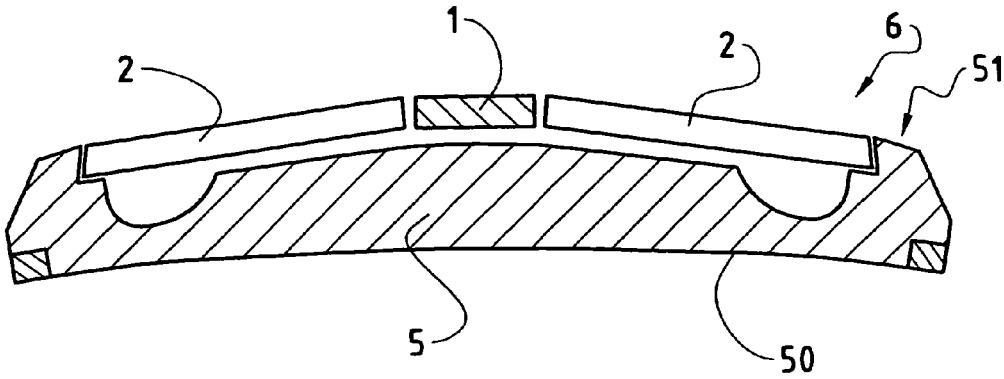
FIG. 4 is a view in transverse section of the spatula of FIG. 2, after modification of the transverse section of this spatula.

On the ski 5, in FIGS. 3 and 4, can be discerned:

a lower face 50, which allows the pressing on a support 7, such as the snow, an upper surface 51, opposite said lower surface 50, lateral faces 52, 53, which, referred to as edges 52, 53, each extend between the lower face 50 and the upper surface 51 and, situated at the base of each of which edges 52, 53 is, for example, a metallic edge 54 which borders the lower face 50.

Likewise discernible on the ski 5, in FIG. 1. are:

two opposite end parts 55, 56, i.e. a first end part 55, curved upward, referred to as spatula 55, and a second end part 56, referred to as heel 56, a median part 57, having a means of fixation 8 for a boot (not shown).

In FIG. 1, the ski 5 has been drawn transversely expanded so as to permit a schematic representation comprising, in particular, functional blocks as functional means.

The device for modification 6 of the radial geometry of the ski 5 is active essentially at the level of at least one of the end parts 55, 56 of the ski 5, preferably both.

The modification device 6 comprises at least one rod 1 of non-compressible material, and this rod 1 is oriented substantially longitudinally to the ski 5 and guided in translation in this direction by a guide means 4 to that effect.

Preferably, but not in a limiting way, the rod 1 comprises carbon fibers held in a matrix of polymeric material.

As has been shown, the rod 1 can be of flattened section, but this is not limiting.

The guide means 4 is, preferably, made up of flanks of a groove made below the level of the upper surface 51 of the ski 5 to accommodate the rod 1, and this on least a portion of the length of this rod 1.

The guide means 4 can also be made up of pieces, in synthetic material or other material, attached and fixed on the upper surface 51 of the ski 5.

The rod 1 co-operates, essentially at the level of one 101 of its opposite ends 101, 102, with a translatory stop 103 connected to the ski 5 in such a way that the flexion of this ski 5 causes a relative displacement of the rod 1 towards one of the end portions of the ski 5.

The end 101 of the rod 1 which co-operates with the translatory stop 103 is referred to as the passive end 101, and the opposite end 102 of the rod 1 is referred to as the active end 102.

Preferably, each translatory stop 103 is situated in the zone of the means of fixation 8 of a boot (not shown) on the ski 5.

During the flexion of the ski 5, the rod 1 likewise flexes.

So that this double flexion can be obtained, the rod 1 must extend, at least partly, outside a plane of the ski 5 containing the fiber referred to as neutral of this ski 5.

During their flexion, the ski 5 and the rod 1 curve according to a bending radius which is particular to them.

The difference between the bending radii of the ski 5 and of the rod 1 induces a substantial displacement of the active end 102 of the rod 1.

It is this relative displacement of the rod 1 which is exploited to cause the modification of the radial geometry of the selected part of the ski 5.

Different solutions can be used to render the ski 5 transversely deformable, both at the level of its spatula 55 as well as at the level of its heel 56.

These solutions depend on the structure of the ski 5 and are thus not described in detail in the present patent application.

Figure 2:
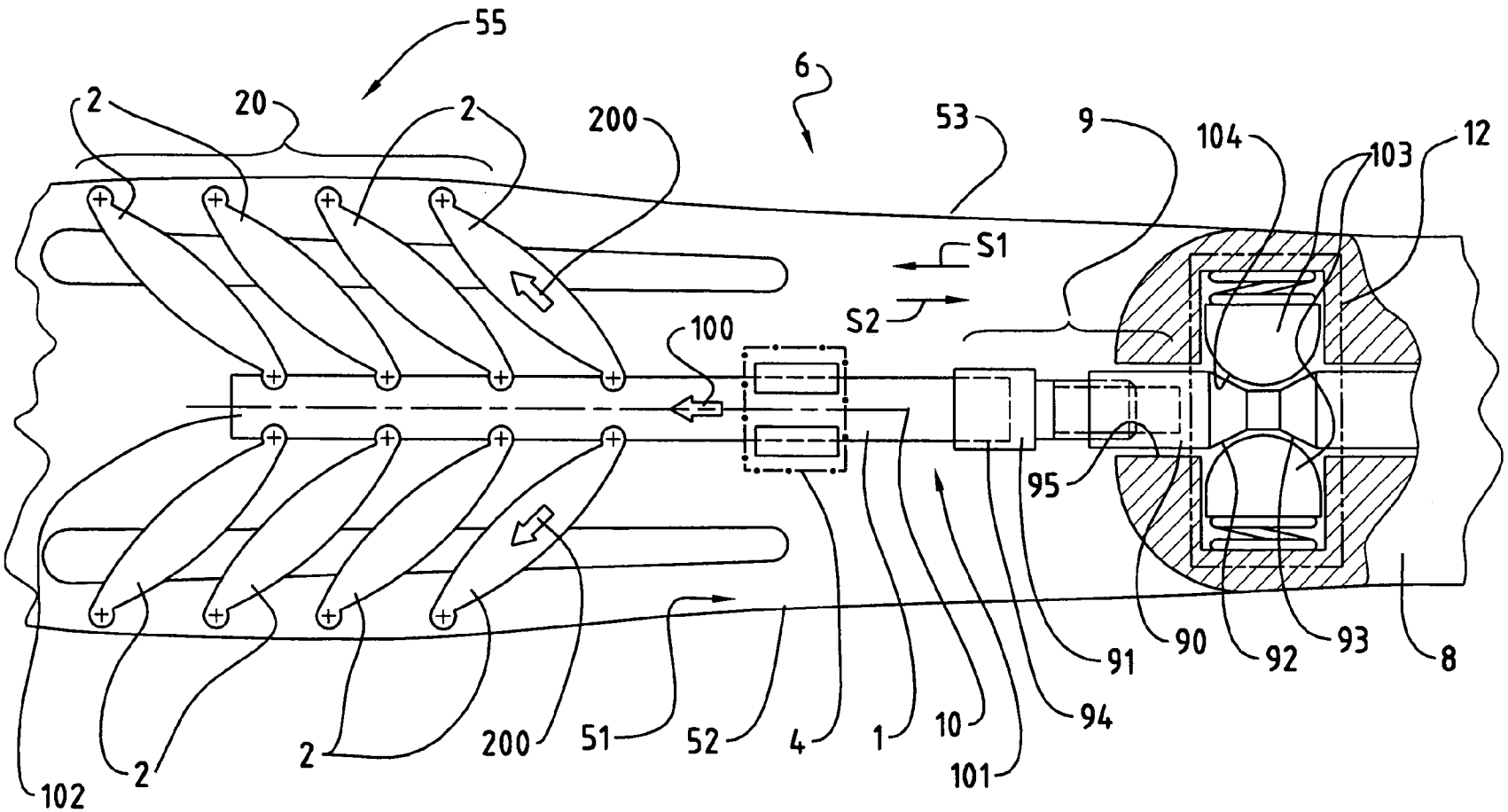
FIG. 2 is on a larger scale, a partial view from above of the ski of FIG. 1, more or less at the level of the spatula.

One solution consisting in a local thinning of the thickness of the ski 5 is symbolized in FIGS. 2 and 3.

In a noteworthy way, instead of exploiting, as in the case of the international application WO 02/40115, the relative displacement of the rod 1 to cause the expansion of a piece which imparts its deformation to the ski 5, the device for modification 6 of the radial geometry according to the invention comprises at least one element 2, referred to as transmission element 2, which, interposed between the rod 1 and the ski 5:

- each transform a relative displacement 100 of the rod 1, oriented along its longitudinal axis 10 and directed towards one of the ends of the ski (direction S1), into a second displacement 200 oriented along a direction intersecting said longitudinal axis 10 and directed towards the outside of the ski 5,
- each apply this displacement 200 at a selected place of the ski 5 so as to bring about, during said relative displacement 100 of the rod 1, a thrust generating the deformation of this ski 5 along its cross-section, translated transverse deformation, in particular through a spacing apart in the upper part of the ski and through the desired modification of the geometry of the lower face 50 of this ski 5.

In a noteworthy way, the modification device 6 comprises at least one row 20 of a plurality of transmission elements 2 spaced apart from one another and oriented with respect to the rod 1, this row 20 of transmission elements 2 being situated on at least one side of the rod 1.

In a first embodiment (FIGS. 1 to 4), the modification device 6 comprises at least one rod 1 and two rows 20 of transmission elements 2 spaced apart from one another and oriented with respect to the rod 1, these rows 20 being situated on both sides of the rod 1, approximately symmetrically with respect to the longitudinal axis 10 of this rod 1.

Figure 5:
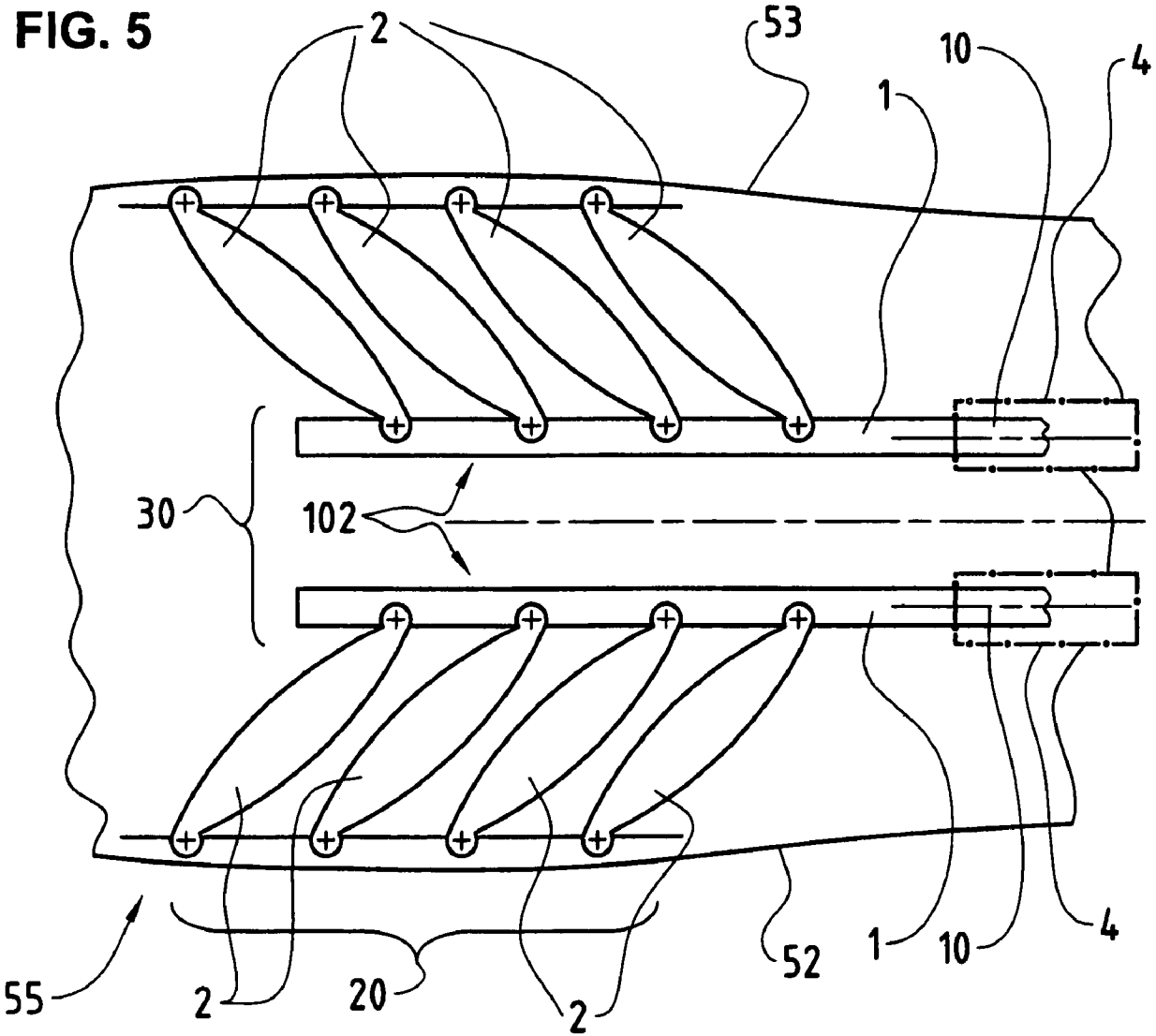
FIG. 5 is a partial view from above of the spatula of a ski equipped with a device according to the invention in a second embodiment.

According to a second embodiment (FIG. 5), the modification device 6 comprises at least one set 30 of two rods 1 which extend substantially parallel to one another, and each between a translatory stop 103 fixed on the ski 5 and the part of the ski 5 the radial geometry of which is supposed to be varied.

In keeping with a variant of the second embodiment, the modification device 6 comprises at least one set 30 of two rods 1 which extend substantially parallel to one of the edges 52, 53 of the ski 5, and each between a translatory stop 103 fixed on the ski 5 and the part of the ski 5 the radial geometry of which is supposed to be varied.

In a noteworthy way, the transmission elements 2 of each row 20 extend substantially parallel to one another in such a way as to form a substantially constant angle with the longitudinal axis 10 of the rod 1 to which they are connected.

According to a variant, the transmission elements 2 of each row 20 extend in such a way as to form with the longitudinal axis 10 of the rod 1 to which they are connected an angle which varies from one transmission element 2 to the other.

As the case may be, the modification device 6 acts upon the ski 5 at a plurality of points spaced according to the longitudinal direction of said ski 5 and not in a concentrated way as in the case of the device of the international application WO 02/40115.

Respecting the aforementioned technical features makes it possible to better control the longitudinal dimension of each part of the ski 5 in which the radial geometry must be modified.

Likewise, the structure and the mode of functioning of the modification device 6 allows the designer of the ski 5 to enhance the capability of the transverse section of his ski 5 to be deformed without this translating into a weakening of the ski 5 because this modification device 6 participates in the mechanical resistance of the ski 5.

In a noteworthy way,

- on the one hand, each translatory stop 103 is of a nature to ensure the stopping in translation of a rod 1 in two opposite directions S1, S2 of displacement of the rod 1 along its longitudinal axis 10, in such a way as to retain the rod 1 in order to make it recoil (direction S2) when the ski 5 is freed from stresses causing its flexion, and
- on the other hand, each transmission element 2 is interposed between the rod 1 and the ski 5 in such a way that when said ski 5 is freed from stresses causing its flexion and the rod 1 recoils, this transmission element 2 applies on the ski 5 a force which causes a modification of the radial geometry opposite to that caused during the displacement of the rod 1 towards the end of said ski 5 equipped with this transmission element 2.

In a manner equally noteworthy, each transmission element 2 is made up of, and acts in the manner of, a connecting rod, i.e. it consists of a piece resistant to compression and articulated on the rod 1 and on the ski 5.

One skilled in the art is able to determine the most appropriate way to achieve these articulated connections.

For example, the rod 1 and the ski 5 comprise recesses and each transmission element includes ends which are shaped so as to fit in these recesses.

Respecting the aforementioned technical features makes it possible to obtain the inventive result according to which the modification device 6 of the aforementioned type, after removal of a flexion stress which has generated a modification of the radial geometry of the ski 5, ensures the re-establishment of this radial geometry in its initial state.

The adaptation of a ski to conditions of the environment can be carried out by replacing each rod 1, for instance, with a longer or shorter and/or more rigid or less rigid rod 1 than that in place.

Preferably, the modification device 6 comprises a means of adjustment 9 of the usable length of each rod 1 which it includes, i.e. of the length of the rod 1 between, on the one hand, the translatory stop 103 with which it co-operates and, on the other hand, the row of transmission elements 2 with which the rod 1 co-operates.

For example, this adjustment means 9 makes it possible to apply to the rod 1 a compression prestressing of predetermined value so as to anticipate the action of pushing of this rod 1 on the transmission elements 2 during the flexion of the ski 5.

For example, this adjustment means 9:

is interposed between the translatory stop 103 and the passive end 101 of the rod 1 intended to co-operate with this stop 103, and can be contracted and expanded substantially along the longitudinal axis 10 of the rod 1.

For example, the adjustment means 9 comprises two pieces 90, 91 assembled through threaded and tapped parts.

one 90 of these pieces 90, 91 has at least one face 92, 93 intended to co-operate with the translatory stop 103, the other piece 91 has a means configured for immobilization 94 of the passive end of the rod 1 in such a way that an action of pushing or traction can be transmitted to the rod 1.

For example, this means configured for immobilization 94 comprises a bore in which the end of the rod situated at the level of said stop is located engaged and immobilized.

Preferably, at least one of the pieces 90, 91 making up the adjustment means 9 have has flat surfaces (not shown) for their actuation with the aid of wrenches (not shown).

In another notable way, the modification device 6 comprises a means of absorption 12 of a translatory displacement of each rod 1 exceeding a predetermined limit in such a way that when the flexion of the ski 5 itself surpasses a predetermined value, the modification device 6 is disconnected in whatever way and there is no damage affecting its operation.

For example, the absorption means 12 is situated at the level of each translatory stop 103 and consists of a mechanism 12 of elastic pushing away of each translatory stop 103 when the latter receives from the rod 1 a force, the intensity of which is beyond the predetermined value, the pushing away of this stop 103 thus allowing the rod 1 to be freed in order to enable its displacement beyond the predetermined limit.

For example, in order to make up the absorption means 12:

the piece 90 of pieces 90, 91 of the adjustment means 9 which is intended to co-operate with the translatory stop 103 is substantially cylindrical in revolution and guided in translation in a bore 95 approximately aligned on the longitudinal axis 10 of the rod 1, has a V-shaped peripheral groove so as to have two conical faces 92, 93, the translatory stop is made up of at least one piece 103 having a rounded surface 104, is guided in translation towards the V-shaped peripheral groove, and is elastically stressed at this recess so as to be firmly held there.

In an embodiment (not shown), the device of the invention comprises at least one rod 1 which extends over substantially the entire length of the ski 5.

For example, the rod 1 passes beneath the means of fixation 8 of the ski boot.

The invention claimed is:

1. A mechanical device for modifying radial geometry of a ski, comprising:

at least one rod;

a plurality of transmission elements interposed between the ski and said at least one rod, said at least one rod having a longitudinal axis extended substantially along a longitudinal direction of the ski, the plurality of transmission elements being configured to transform a first displacement of the at least one rod into a second displacement, the first displacement being caused by a flexion of the ski, oriented along the longitudinal axis and directed towards a first end of the ski, the second displacement being oriented along a direction intersecting the longitudinal axis and directed towards an outside of the ski, wherein the plurality of transmission elements apply the second displacement at a selected place of the ski to produce a thrust generating a transverse deformation of the ski along a cross-section of the ski during the first displacement of the at least one rod, and the plurality of transmission elements are configured to apply a third displacement to produce a reverse thrust that is opposite in direction to the thrust produced by the second displacement when the flexion of the ski is removed.

2. The device according to claim 1, wherein the plurality of transmission elements comprise at least one row of transmission elements spaced apart from one another and oriented towards the at least one rod, and the at least one row of transmission elements is positioned on at least one side of the at least one rod.

3. The device according to claim 2, wherein the at least one rod comprises at least one set of two rods extended substantially parallel to one another and positioned between a translatory stop fixed on the ski and a part of the ski a radial geometry of which is varied.

4. The device according to claim 3, wherein the two rods are offset to one another in a width direction of the ski.

5. The device according to claim 2, wherein the at least one rod comprises at least one set of two rods extended substantially parallel to one of edges of the ski and positioned between a translatory stop fixed on the ski and a part of the ski the radial geometry of which is varied.

6. The device according to claim 5, wherein the two rods are offset to one another in a width direction of the ski.

7. The device according to claim 1, wherein the plurality of transmission elements comprise two rows of transmission elements spaced apart from one another and oriented towards the at least one rod, and the two rows are situated on both sides of the at least one rod, approximately symmetrically with respect to the longitudinal axis of the at least one rod.

8. The device according to claim 1, wherein the plurality of transmission elements comprise at least one row of transmission elements connected to the at least one rod, and the transmission elements of each row extend substantially parallel to one another to form a substantially same angle with respect to the longitudinal axis of the at least one rod to which the transmission elements are connected.

9. The device according to claim 1, wherein the plurality of transmission elements comprise at least one row of transmission elements connected to the at least one rod, and the transmission elements of each row extend to form different angles from one another with respect to the longitudinal axis of the at least one rod to which the transmission elements are connected.

10. The device according to claim 1, wherein each of the plurality of transmission elements include a piece resistant to compression and articulated on the at least one rod and on the ski.

11. The device according to claim 1, further comprising:

a translatory stop configured to stop a translation of the first displacement of the at least one rod; and means for adjusting a length of the at least one rod between the translatory stop with which the at least one rod co-operates and the plurality of transmission elements with which the at least one rod co-operates.

12. The device according to claim 1, further comprising:

means for absorbing the first displacement of the at least one rod exceeding a predetermined limit by disconnecting the at least one rod from the mechanical device when the flexion of the ski surpasses a predetermined value.

13. A ski equipped with the mechanical device according to claim 1.

14. The device according to claim 1, wherein the plurality of transmission elements are spaced apart from one another in an upper part of the ski.

15. The device according to claim 1, wherein the plurality of transmission elements modify a geometry of a lower face of the ski proportionally to the flexion of the ski.

16. The device according to claim 15, wherein the plurality of transmission elements are configured to cause the lower face of the ski to have a concave shape when the second displacement is applied.

17. A mechanical device for modifying radial geometry of a ski, comprising:

at least one rod;

at least one transmission element interposed between the ski and said at least one rod, said at least one rod having a longitudinal axis extended substantially along a longitudinal direction of the ski, the at least one transmission element being configured to transform a first displacement of the at least one rod into a second displacement, the first displacement being caused by a flexion of the ski, oriented along the longitudinal axis and directed towards a first end of the ski, the second displacement being oriented along a direction intersecting the longitudinal axis and directed towards an outside of the ski, wherein the at least one transmission element applies the second displacement at a selected place of the ski to produce a thrust generating a transverse deformation of the ski along a cross-section of the ski during the first displacement of the at least one rod, at least one translatory stop configured to stop a translation of the first displacement of the at least one rod in two opposite directions along the longitudinal axis to retain the at least one rod and make the at least one rod recoil when the ski is freed from stresses causing the flexion thereof, wherein each of the at least one transmission element is interposed between the at least one rod and the ski such that when the ski is freed from stresses causing the flexion and the at least one rod recoils, the at least one transmission element applies on the ski a force that causes a modification of the radial geometry opposite to a modification of the radial geometry caused during the first displacement of the at least one rod towards the first end of the ski.

18. A mechanical device for modifying radial geometry of a ski, comprising:

at least one rod;

at least one transmission element interposed between the ski and said at least one rod, said at least one rod having a longitudinal axis extended substantially along a longitudinal direction of the ski, the at least one transmission element being configured to transform a first displacement of the at least one rod into a second displacement, the first displacement being caused by a flexion of the ski, oriented along the longitudinal axis and directed towards a first end of the ski, the second displacement being oriented along a direction intersecting the longitudinal axis and directed towards an outside of the ski, wherein the at least one transmission element applies the second displacement at a selected place of the ski to produce a thrust generating a transverse deformation of the ski along a cross-section of the ski during the first displacement of the at least one rod, means for absorbing the first displacement of the at least one rod exceeding a predetermined limit by disconnecting the at least one rod from the mechanical device when the flexion of the ski surpasses a predetermined value, at least one translatory stop configured to stop a translation of the first displacement of the at least one rod, wherein the means for absorbing the first displacement is positioned at a level of each of the at least one translatory stop and includes an elastic mechanism configured to push away each of the at least one translatory stop and free the at least one rod to enable the first displacement beyond the predetermined limit when the at least one translatory stop receives from the at least one rod a force beyond a predetermined value.

* * * * *